US008807863B2

(12) United States Patent
Pearson et al.

(10) Patent No.: US 8,807,863 B2
(45) Date of Patent: Aug. 19, 2014

(54) METHOD AND APPARATUS FOR SECURING COLLAPSED SHIPPING RACKS

(75) Inventors: John Pearson, Red Bank, NJ (US); Michael Chilkotowsky, Mount Holly, NJ (US); Lewis Vitalis, Medford Lakes, NJ (US)

(73) Assignee: TAL International Container Corp., Purchase, NY (US)

( * ) Notice: Subject to any disclaimer, the term of this patent is extended or adjusted under 35 U.S.C. 154(b) by 810 days.

(21) Appl. No.: 12/854,360

(22) Filed: Aug. 11, 2010

(65) Prior Publication Data

US 2011/0038664 A1 Feb. 17, 2011

Related U.S. Application Data

(60) Provisional application No. 61/233,025, filed on Aug. 11, 2009.

(51) Int. Cl.

| | |
|---|---|
| ***B25G 3/18*** | (2006.01) |
| ***F16B 21/00*** | (2006.01) |
| ***F16D 1/00*** | (2006.01) |

(52) U.S. Cl.

USPC ..... 403/324; 403/325; 206/503; 206/509

(58) Field of Classification Search

USPC ..... 403/220, 224, 225, 324, 325, 326, 327, 403/348, 353; 206/503, 509; 211/194, 195; 108/53.1, 91; 410/77, 80, 97, 100

See application file for complete search history.

(56) References Cited

U.S. PATENT DOCUMENTS

| | | | | |
|---|---|---|---|---|
| 2,722,837 | A * | 11/1955 | Dwyer | 73/715 |
| 3,083,670 | A | 4/1963 | Harlander et al. | |
| 3,173,539 | A * | 3/1965 | Looker | 206/597 |
| 3,601,866 | A | 8/1971 | Odin | |
| 3,734,315 | A * | 5/1973 | James | 414/281 |
| 3,749,273 | A | 7/1973 | Wreghitt et al. | |

(Continued)

FOREIGN PATENT DOCUMENTS

| | | | |
|---|---|---|---|
| CN | 1505576 | A | 6/2004 |
| CN | 101554947 | A | 10/2009 |
| EP | 1391378 | A1 | 2/2004 |

OTHER PUBLICATIONS

29 CFR Parts 1917 and 1918; Dec. 10, 2008.

(Continued)

*Primary Examiner* — Michael P Ferguson
*Assistant Examiner* — Nahid Amiri
(74) *Attorney, Agent, or Firm* — Gardner, Linn, Burkhart & Flory, LLP

(57) ABSTRACT

A securement device is provided for securing articles such as collapsed shipping racks together for maintaining their stability and alignment. The device includes a tether that is connectable between adjacent shipping racks to secure the racks together, and that provides a clear visual indication that the racks are secured. A securement device affixed to a collapsible shipping rack may further comprise a bracket member and upper and lower pin members coupled to the bracket member, with the tether having first and second opposite end portions and the first end portion of the tether being coupled to one of the upper and lower pin members, and the second end portion being releasably attachable to another securement device of another collapsible shipping rack adjacently stacked relative to the first collapsible shipping rack.

22 Claims, 10 Drawing Sheets

(56) References Cited

U.S. PATENT DOCUMENTS

| | | | | | |
|---|---|---|---|---|---|
| 3,776,169 | A | * | 12/1973 | Strecker | 410/77 |
| 3,980,185 | A | * | 9/1976 | Cain | 206/509 |
| 4,221,515 | A | * | 9/1980 | Brown et al. | 410/32 |
| 4,258,631 | A | * | 3/1981 | Brown | 108/91 |
| 5,195,426 | A | * | 3/1993 | Thuli | 99/452 |
| 5,249,760 | A | * | 10/1993 | Morimoto | 242/279 |
| 5,743,583 | A | * | 4/1998 | Lowe | 296/3 |
| 5,979,476 | A | * | 11/1999 | Cranny | 135/67 |
| 7,255,400 | B2 | * | 8/2007 | Holdampf | 297/391 |
| 7,658,887 | B2 | * | 2/2010 | Hovatter | 422/536 |

OTHER PUBLICATIONS

Images of flatrack shipping containers depicting constructions believed to be in use more than one year prior to Aug. 11, 2009. Document transmitted by China Int. Marine Containers (CIMC) to TAL International Container Corp. Sep. 2012.

* cited by examiner

METHOD AND APPARATUS FOR SECURING COLLAPSED SHIPPING RACKS

CROSS REFERENCE TO RELATED APPLICATION

The present application claims the benefit of U.S. provisional patent application Ser. No. 61/233,025, filed Aug. 11, 2009, by John Pearson, Lewis Vitalis, and Michael Chilkotowsky for METHOD AND APPARATUS FOR SECURING COLLAPSED SHIPPING RACKS, which is hereby incorporated herein by reference in its entirety.

FIELD OF THE INVENTION

The present invention relates generally to securement devices, and, more particularly, to securement devices for use on stackable shipping racks.

BACKGROUND OF THE INVENTION

Shipping racks are used for transporting various articles, and may include movable or collapsible walls that are raised or extended for shipping or moving articles thereon, while being retractable or collapsible to save space while the shipping racks are being stored or transported without supporting other articles. Typically, such shipping racks are stackable, and may include interconnectors to facilitate alignment and stability of the racks when they are stacked atop one another.

SUMMARY OF THE INVENTION

The present invention provides a securement device for collapsed shipping racks or containers that is readily and securely engageable and disengageable with stacked racks to connect or join shipping racks that are stacked atop one another so that the racks may be stored, lifted, and transported without substantial risk of the stacked racks toppling over. The securement device includes a tether, such as a chain or flexible cable or the like, positioned along an exterior surface of each shipping rack, with a free end that is attachable to a bracket on an adjacent shipping rack; such as when the shipping racks are stacked atop one another. A removable pin at each bracket releasably engages the tether from another bracket so that the shipping racks can be readily attached to and detached from one another simply by engaging and disengaging the tether with the removable pin. Optionally, the tether of a lower shipping rack is releasably attachable to a removable pin at the bracket of a shipping rack located immediately above the lower shipping rack, so that when the tether is not attached to the removable pin of the adjacent shipping rack, the tether hangs down along a side or end of the lower shipping rack to provide a clear and easy-to-see indication that the shipping racks are not secured and are in a potentially unsafe condition.

According to an aspect of the present invention, A collapsible shipping rack securement device used to secure adjacent racks together when collapsed and stacked comprises a first securement device at a first collapsible shipping rack, with the first securement device comprising a bracket member, upper and lower pin members coupled at the bracket member, and a tether having first and second opposite end portions. The first end portion of the tether is coupled to one of the upper and lower pin members, and the second end portion is releasably attachable to a second securement device of a second collapsible shipping rack when the first shipping rack is adjacently stacked relative to the second collapsible shipping rack to securely and releasably couple the first collapsible shipping rack and the second collapsible shipping rack together in a stacked arrangement.

The upper pin member may be fixedly coupled at the bracket member and the lower pin member may be releasably coupled at the bracket member, with the first end portion of the tether being engaged by the upper pin member to generally fixedly attach the first end portion of the tether to the bracket member and the second end portion of the tether being releasably engageable by a lower pin member of the second securement device when the second collapsible shipping rack is stacked above the first collapsible shipping rack. The bracket member may also include a through-hole for movably receiving the lower pin member, with the lower pin member being movable to releasably attach a tether from a third securement device of a third collapsible shipping rack to the first securement device with the first collapsible shipping rack being stacked above the third collapsible shipping rack. Still further, the lower pin member may include a projection extending generally radially outwardly from a shaft with the through-hole including a notch through which the projection is passed. The projection of the lower pin member may be alignable with the notch to permit insertion of the lower pin member into the through-hole, and the projection may be misaligned with the notch to substantially prevent removal of the lower pin member from the through-hole when the projection is oriented to be misaligned with the notch. The lower pin member may also include a handle extending generally radially outwardly from the shaft with the shaft being rotatable and horizontally slidable within the through-hole of the bracket member and the handle tending to maintain the shaft in an orientation in which the projection is misaligned with the notch via gravity.

According to another aspect of the present invention, a method of securing a plurality of shipping racks to one another comprises providing at least two shipping racks, each of which includes a securement device having respective bracket members, upper and lower pin members at the bracket members, and a tether having opposite end portions. The method further includes positioning one of the shipping racks atop the other whereby the bracket members of the shipping racks are aligned, attaching one of the opposite end portions of the tether of a securement device of a first shipping rack to one of the upper and lower pin members of the securement device of the first shipping rack, and releasably attaching the other end portion of the tether of the securement device of the first shipping rack to one of the upper and lower pin members of the securement device of the other shipping rack. In a particular embodiment, the step of attaching comprises coupling a first opposite end portion of the tether of the securement device of the first shipping rack to the upper pin member of the securement device of the first shipping rack, and wherein the step of releasably attaching comprises releasably coupling the second opposite end portion of the tether of the securement device of the first shipping rack to the lower pin member of the securement device of the other shipping rack when the other shipping rack is stacked atop the first shipping rack.

These and other objects, advantages, purposes, and features of the present invention will become apparent upon review of the following specification in conjunction with the drawings.

DESCRIPTION OF THE PREFERRED EMBODIMENTS

Figure 1:
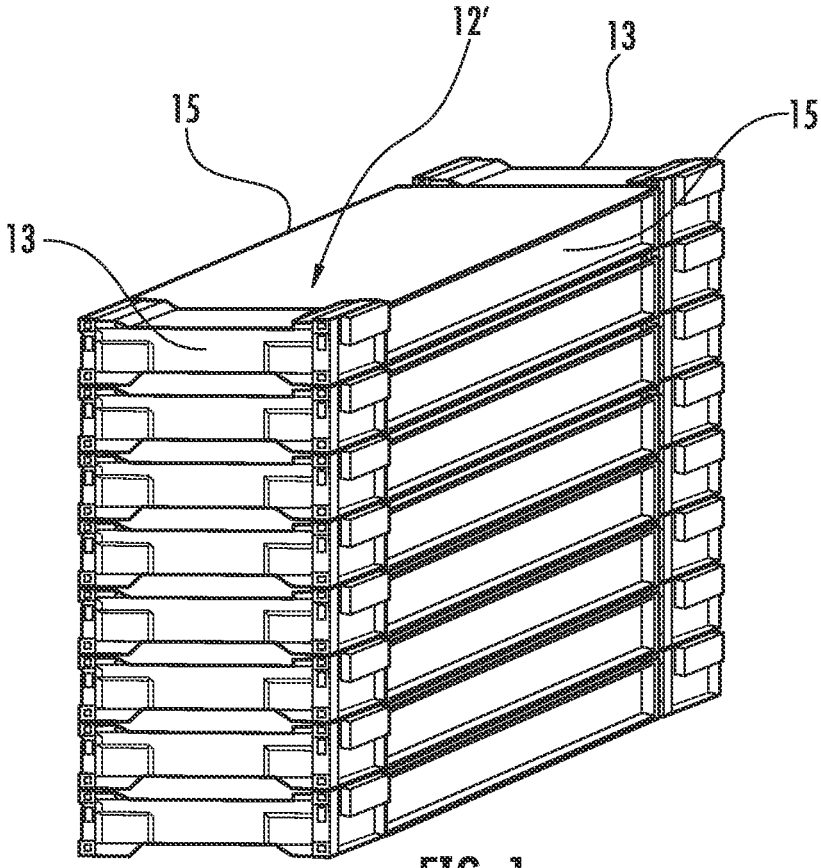
FIG. 1 (PRIOR ART)
FIG. 1 is a perspective view of a plurality of prior art collapsible shipping racks in a collapsed and stacked arrangement.
Figure 2:
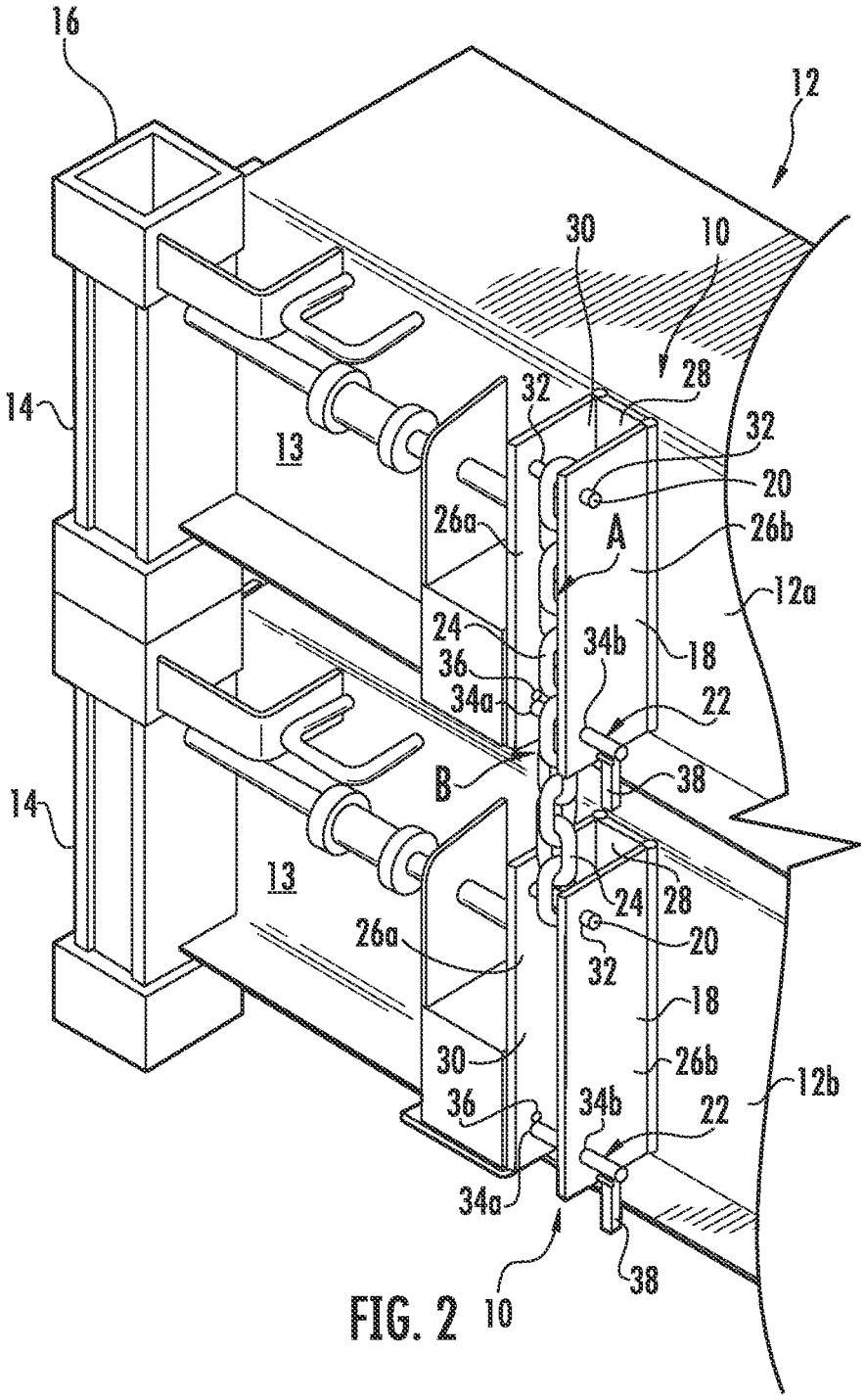
FIG. 2 is a perspective view of two securement devices in accordance with the present invention, with portions of two collapsed shipping racks shown in stacked arrangement.
Figure 3:
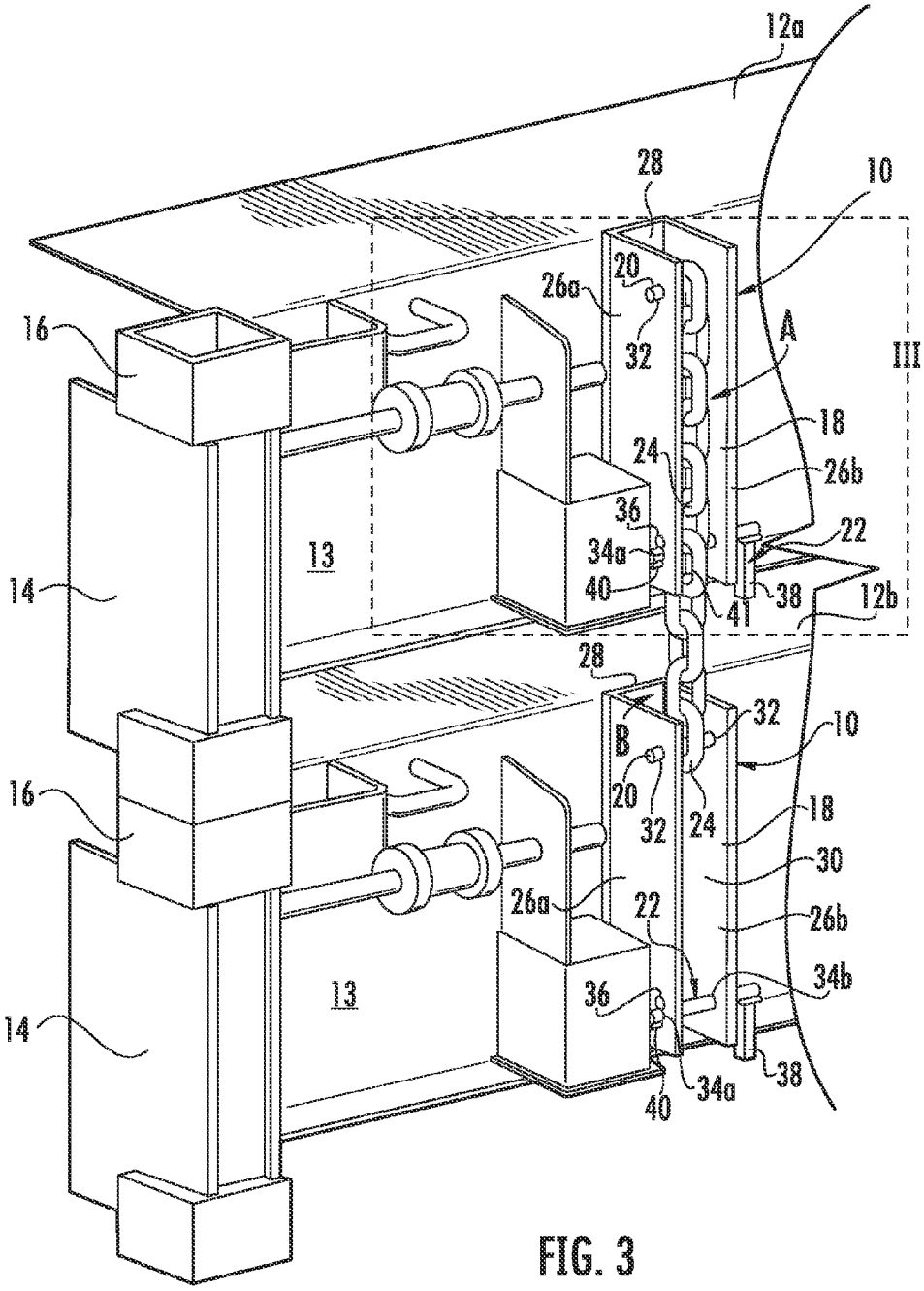
FIG. 3 is another perspective view of the securement devices and shipping rack portions of FIG. 2.
Figure 4:
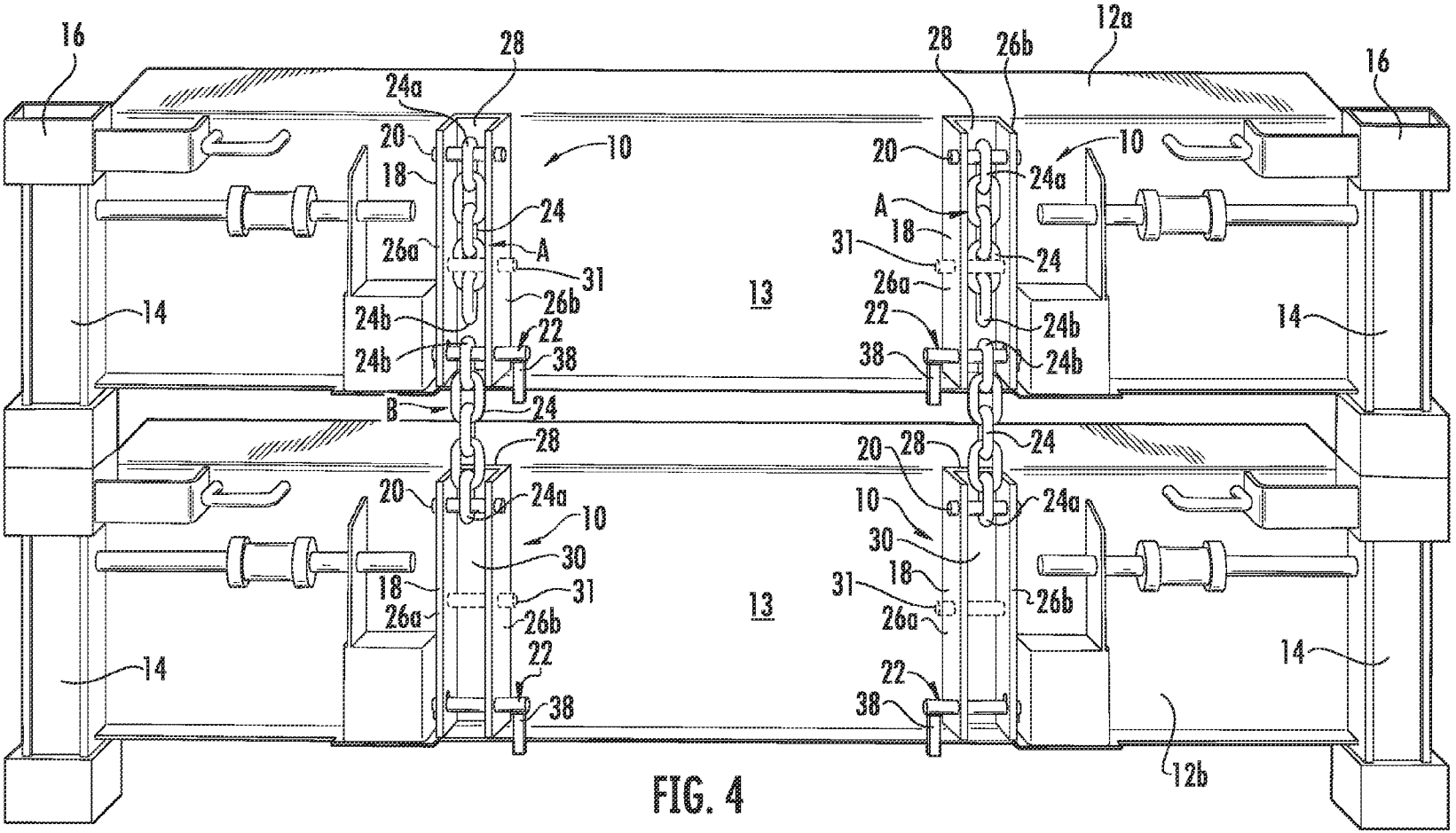
FIG. 4 is a perspective view of the securement devices of FIG. 2 showing the end side portions of the two collapsed shipping racks with additional securement devices.
Figure 5:
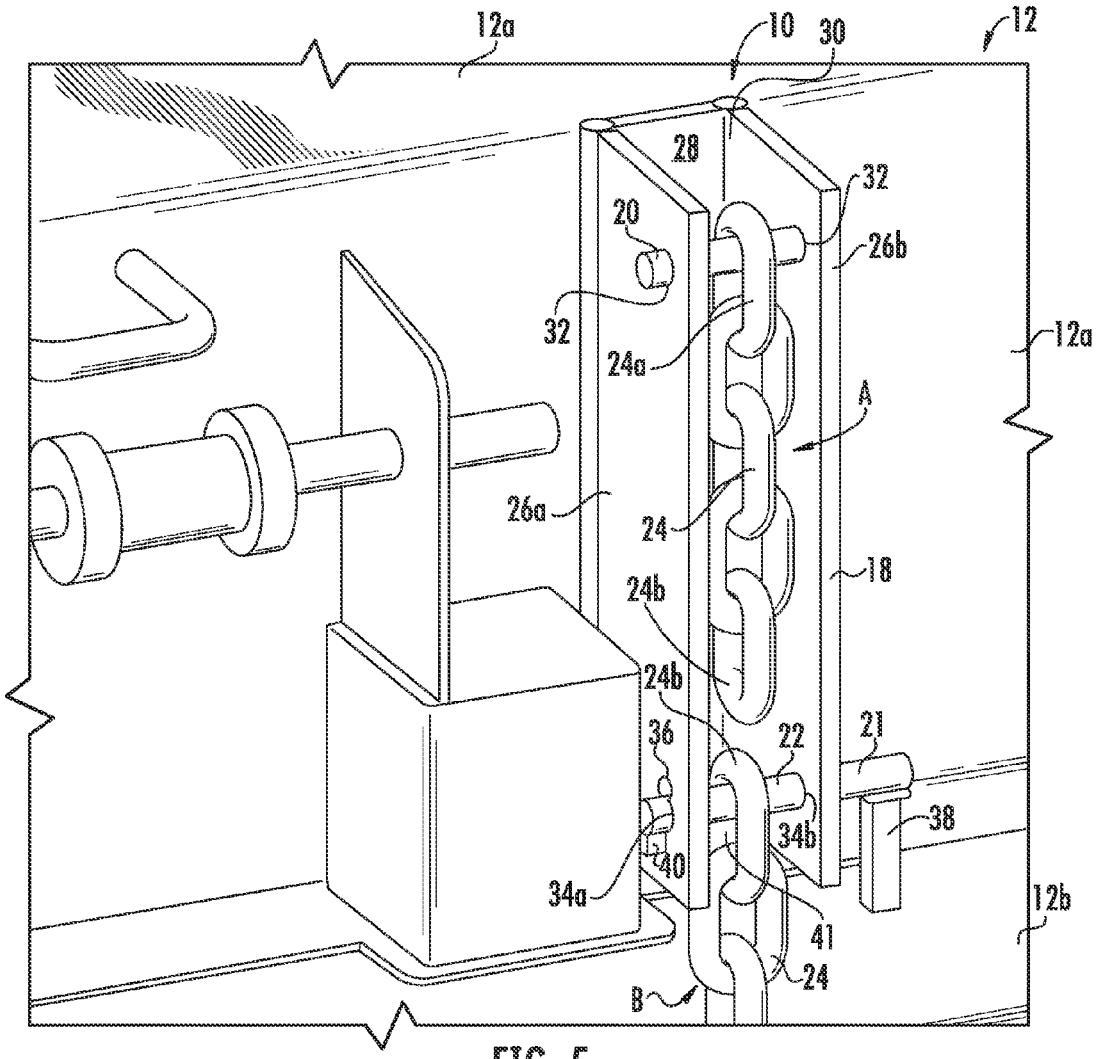
FIG. 5 is an enlarged perspective view of the area designated III in FIG. 3.
Figure 6:
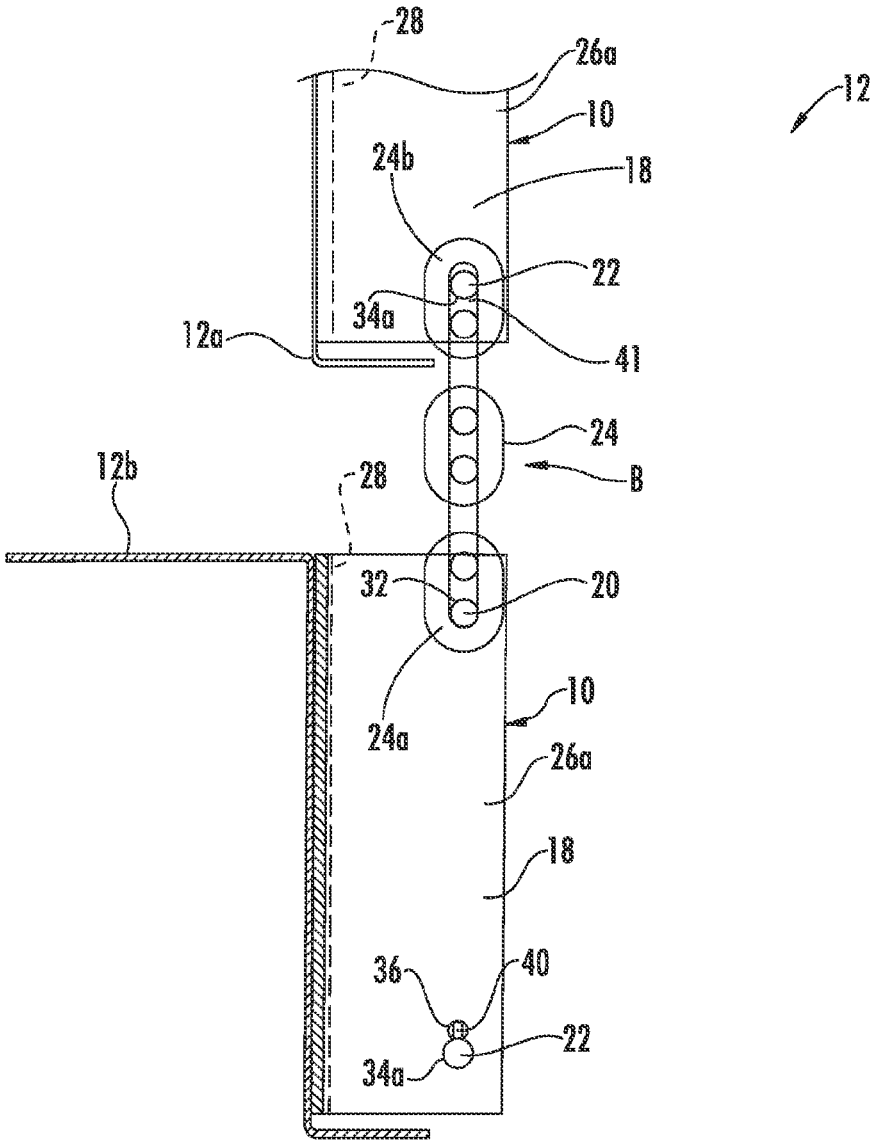
FIG. 6 is a side sectional view of portions of the securement devices of FIG. 2.

Referring now to the drawings and the illustrative embodiments depicted therein, a securement device 10 is attachable to an outer portion of an end or side wall of a collapsible shipping rack or container 12, each securement device 10 being connectable to an adjacent securement device 10 of a shipping rack 12 (such as a shipping rack stacked on top of the first shipping rack), such as shown in FIGS. 2-4. As with prior art shipping racks 12' (FIG. 1), shipping racks 12 may be stacked atop one another to facilitate handling and efficient storage of the racks in a stacked configuration, such as when the racks or containers are collapsed for storage and/or shipping from one location to another location. The securement devices are operable to secure the stacked shipping racks to one another, and provide a clear visual indication when the devices are secured so that users or operators may readily determine, even from a distance, whether a stack of racks is secure and safe to move.

Collapsible shipping racks 12 are generally rectangular with end sides 13 and elongate sides 15 (FIG. 1) with moveable or removable walls. The shipping racks 12 may include conventional interconnectors located at the corner regions 14 of racks 12. Such interconnectors include a male extension or post (not shown) extending upward from an upper corner region 16, and female receiving portions or sockets arranged opposite the upper corner region 16 for receiving the post of an adjacent rack. The male posts of a lower shipping rack 12*b* align with and are received in corresponding female portions of an upper shipping rack 12*a*, which ensures alignment of stacked shipping racks and limits the freedom of movement of stacked shipping racks relative to one another. Each securement device 10 is attached to or disposed at a respective shipping rack (such as upper and lower shipping racks 12*a*, 12*b*), and is attachable to a portion of the corresponding securement device of an adjacent shipping rack to secure adjacent shipping racks 12*a*, 12*b* to one another by limiting or substantially precluding or preventing disengagement of adjacent shipping racks from one another. It will be appreciated that securement devices 10 may supplant the locking capabilities of conventional interconnectors, which are exemplary of features that provide a stabilizing and alignment function for stacked articles such as shipping racks 12, but that other alignment/stabilizing features, such as intermeshing grooves, magnets, or the like, may be used to provide alignment and stability for the stacked articles, which may be positioned one atop the other as in the illustrated embodiments, or side-by-side.

Securement devices 10 include bracket members 18, upper pins 20, lower pins 22, and tethers or tether elements 24. In the illustrated embodiment of FIGS. 2-7, bracket members 18 are generally U-shaped or channel-shaped and include a pair of generally parallel and outwardly-projecting left and right arms 26*a*, 26*b* extending perpendicularly from a base portion 28 in a generally U-shaped configuration to define a generally vertically oriented channel 30 between arms 26*a*, 26*b* when bracket member 18 is attached to the respective shipping rack. Upper pin 20 and lower pin 22 each span across channel 30 and engage both arms 26*a*, 26*b* of bracket member 18. As will be described in greater detail below, tether 24 is coupled at a first end 24*a* to an upper pin 20 of the securement device, and is releasably connectable at a second end 24*b* (opposite first end 24*a*) to a lower pin 22 of another securement device at an adjacent shipping rack. When not engaged with the lower pin 22 of the adjacent securement device, tether 24 is suspended from upper pin 20 and hangs between arms 26*a*, 26*b* inside vertical channel 30, such as shown at 'A' in FIGS. 2-5. When the tether 24 is coupled to the lower pin 22 of the bracket member 18 of an upper securement device 10 (i.e. the securement device coupled to upper shipping rack 12*a*, which is positioned directly above lower shipping rack 12*b* to which tether 24 is attached), tether 24 extends upwardly from the upper pin 20 of the bracket member 18 of the lower shipping rack 12*b*, and spans between respective vertical channels 30 of the adjacent bracket members 18 (as shown with reference to the bracket members and tethers (at 'B') of the lower shipping rack 12*b* in FIGS. 2-4 and 6). Thus, tethers 24 are operable to connect the upper pin 20 of a bracket member 18 of the lower shipping rack 12*b* to the lower pin 22 of a bracket member 18 of the upper shipping rack 12*a*, which prevents separation of adjacent shipping racks 12*a*, 12*b*.

With reference to FIG. 4, in the illustrated embodiment each rack includes a pair of securement devices 10 located on each end side 13 of racks 12 (with only one end side 13 being shown in FIG. 4) such that each rack 12 includes four total securement devices 10, with each securement device 10 being positioned adjacent or in proximity to a separate corner region 14. Alternative numbers and arrangements of securement devices 10 may be employed. For example, a pair of securement devices 10 may be additionally or alternatively positioned on each elongate side 15 (see FIG. 1), or only a single securement device 10 may be positioned on one or more sides of rack 12. It should also be appreciated that although disclosed and described in connection with two stacked collapsible shipping racks the illustrated embodiment that the present invention is useable in connection with more than two stacked collapsible shipping racks. For example, each one of a plurality of collapsed and stacked collapsible shipping racks, such as illustrated in FIG. 1, can be provided with one or more securement devices 10 that are aligned with securement devices 10 on the adjacently stacked shipping racks to enable each collapsed shipping rack to be secured to the shipping racks that are adjacently stacked above and/or below. A securement device, such as is also illustrated in FIG. 4 with respect to securement devices 10, may additionally include a retainer or chain retainer 31 used to aid in retaining a tether 24 in place when the tether 24 is not connected to a securement device 10 of an adjacent shipping rack, such as is employed with the securement devices 10 of shipping rack 12*a* in FIG. 4. Retainer 31 may comprise a pin or rod positioned between the arms 26*a*, 26*b* of bracket members 18 such that the respective tether 24 may be positioned behind the chain retainer 31 to thereby inhibit the tether 24 from swinging outwardly from the securement device 10 when the tether 24 is not in use and the shipping rack 12 is moved. Retainers 31 may, for example, comprise steel rods of approximately ¼ to ⅜ inch diameter that are welded or otherwise fixed to each arm 26, and may be positioned along the length of bracket members 18 such that, when tether 24 is constructed as a chain, retainers 31 contact a link of chain 24 having a planar orientation that is generally perpendicular to arms 26, as shown with the shipping rack 12*a* of FIG. 4.

Bracket members 18 are welded or otherwise fastened or secured to racks 12 at base portions 28, and include an upper through-hole 32 in each arm 26*a*, 26*b*, the upper through-holes 32 being generally aligned with one another for mounting upper pins 20 in a generally perpendicular orientation to anus 26*a*, 26*b*. Upper pins 20 may be fixedly mounted to arms 26*a*, 26*b* at upper through-holes 32 by welding, or with fasteners or the like, and may be inserted through first end portion or fixed end portion 24*a* of tether 24 so as to fixedly or substantially permanently couple tether 24 to bracket member 18. Arms 26*a*, 26*b* further define left and right lower through-holes 34*a*, 34*b* that are generally aligned with one another to support lower pins 22 in a generally perpendicular orientation relative to arms 26*a*, 26*b*. Lower through-holes 34*a*, 34*b* may be slightly larger than the diameter of lower pins 22. As shown in the illustrated embodiment, the left lower through-hole 34*a* in left arm 26*a* includes at least one notch 36 for releasably securing the lower pin 22 therein, as will be described below. Optionally, both through-holes 34*a*, 34*b* may include notches so that lower pin 22 may be completely removed from bracket member 18. Bracket members 18 may be made from substantially similar material to shipping racks 12, such as steel or other sufficiently strong material, and may be coupled or joined to an outer surface of each shipping rack 12 via welding, or with fasteners or other coupling or joining methods. Still further, a pair of separate plate members that are not joined together by a base portion (such as base portion 28) may each be welded directly to a side or end wall of a shipping rack in a spaced arrangement to form a bracket member within the scope of the present invention.

Tethers 24 are generally flexible and strong elements having loops at first end portion 24*a* and second end portion 24*b* for connection to upper pin 20 and lower pin 22 respectively. For example, and as shown, tether 24 may comprise a chain such as a conventional chain having multiple links, such as ¾-inch Grade-80 chain, available from McMaster-Carr Supply Company, of Atlanta, Ga., as Part No. 3587T18. However, it will be appreciated that various other types of tethers may be suitable for use with the present invention. For example, cables (such as steel cables or the like) having a loop formed at either end may be equally suitable. Optionally, special coupling features may be added at either or both ends of tether 24, such as hooks or coupling plates (described below with respect to FIGS. 8-10), or other connection devices for coupling the tethers to bracket members 18.

Optionally, instead of flexible tethers, it is envisioned that a rigid or solid member or element may be used that is pivotably mounted to upper pins 20 and coupleable to lower pins 22. Thus, any cable, chain, or rigid member that is coupleable between the upper pin of a bracket member of the lower shipping rack 12*b* and the lower pin of a bracket member of the upper shipping rack 12*a* may be suitable. The length of tethers is selected to secure the upper and lower shipping racks relative to one another and limit or substantially preclude separation (such as vertical movement of one of the shipping racks away from the other shipping rack), in order to limit or substantially preclude or prevent removal of posts 14 from sockets 16 of the stacked shipping racks 12 when the tethers are fully installed between adjacent or stacked racks, thereby enhancing the stability of a plurality of stacked shipping racks and preventing the shipping racks from inadvertently separating from one another. It will be appreciated that some degree of slack is permissible in the tethers when they are fully attached, so long as the shipping racks are retained in close arrangement so that posts 14 are retained in sockets 16 to maintain alignment of the racks.

Figure 7:
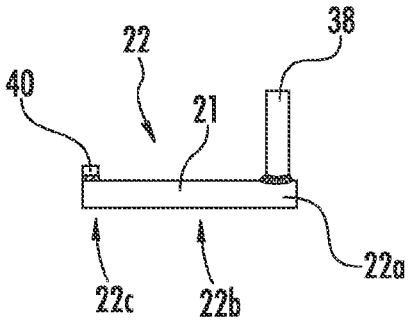
FIG. 7 is a side elevation of a pin element that is useful with the securement device of the present invention.

As best shown in FIG. 7, lower pin 22 includes a shaft 21 with a proximal end portion 22*a*, a middle portion 22*b*, and a distal end portion 22*c*. A handle portion or extension 38 extends generally perpendicularly to proximal end portion 22*a* and provides a gripping surface to facilitate installation and removal of the lower pin 22 from the lower through-holes 34 of bracket member 18. The weight of handle portion 38 further serves to bias lower pin 22 to a desired orientation due to gravity, as will be described below. Middle portion 22*b* and distal portion 22*c* of lower pin 22 are of generally constant diameter, while distal portion 22*c* includes a radial projection 40 sized to correspond with notch 36 in lower through-hole 34. Projection 40 extends from shaft 21 at the same side or in the same radial direction as handle portion 38, so that both handle portion 38 and projection 40 extend upwardly from shaft 21 for insertion of radial projection 40 through notch 36 in lower through-hole 34.

After projection 40 has passed through notch 36 and is positioned outboard of the left arm 26*a* that supports distal end portion 22*c* of lower pin 22, lower pin 22 is rotated approximately 180 degrees, such as by using handle portion 38, so that radial projection 40 and handle portion 38 extend downwardly, which misaligns projection 40 with notch 36 and limits or substantially precludes removal of the lower pin 22 from lower through-holes 34 when the lower pin is in that orientation. The weight of handle portion 38 biases or maintains pin 22 in the misaligned orientation and thus prevents inadvertent or unintentional realignment of radial projection 40 with notch 36 so that lower pin 22 cannot be removed from bracket member 18 until lower pin 22 is manually rotated approximately 180 degrees to realign radial projection 40 with notch 36. Second end 24*b* of tether 24 is releasably coupleable to lower pin 22 by inserting the lower pin 22 into an opening or loop 41 at the second end 24*b*, within vertical channel 30, further inserting distal end portion 22*b* and radial projection 40 of lower pin 22 through lower through-hole 34*b*, and rotating the lower pin to lock the pin in place and thereby prevent removal of the tether. Although projection 40 is shown to extend outwardly from shaft 21 in the same radial direction relative to handle portion 38, an alternative pin may be constructed in which the tendency of the handle portion to rotate by gravity causes the shaft to rotate the projection into a misalignment orientation relative to notch 36 without the projection extending from the shaft in the same radial direction relative to the handle.

Figure 7A:
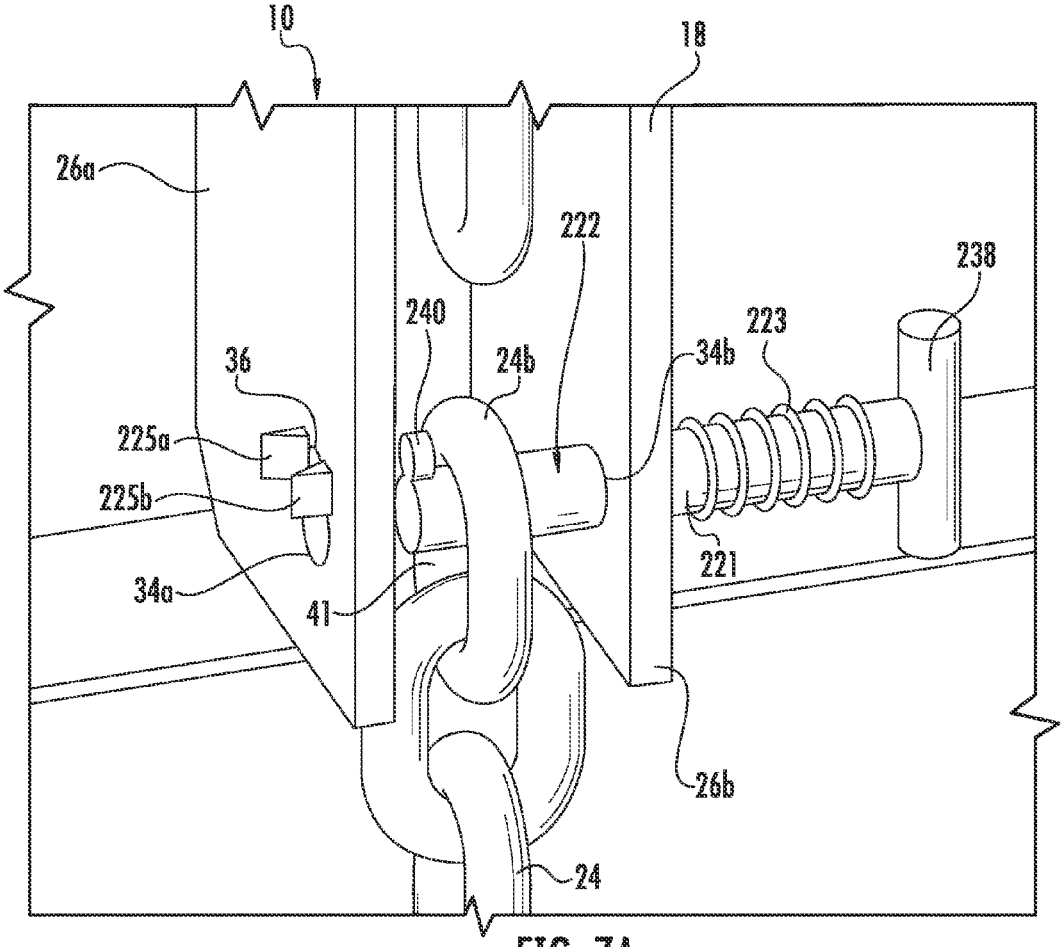
FIG. 7A is a perspective view of an alternative pin of a securement device in accordance with the present invention.
Figure 7B:
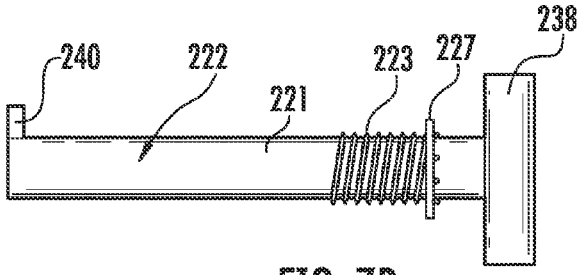
FIG. 7B is a side elevation view of the pin of FIG. 7A.

Referring now to FIGS. 7A and 7B, an alternative lower pin 222 is illustrated having a spring 223 disposed about shaft 221. When lower pin 222 is installed to bracket 18, spring 223 is positioned between handle 238, which is a T-handle in the illustrated embodiment, and the outside of arm 26*b* such that spring 223 biases lower pin 222 to an open or disengaged position. Engagement of lower pin 222 is accomplished by pushing radial projection 240 of pin 222 through through-hole 34 against spring 223 when radial projection 240 is aligned with notch 36 and rotating lower pin 222 such that radial projection 240 is not aligned with notch 36 of through-hole 34. Spring 223 provides an additional safety factor by providing a visual indicator when lower pin 222 is not in place as T-handle 238 will project away from arm 26*b*. FIG. 7A also discloses the inclusion of optional locking tabs 225*a*, 225*b* on arm 26*a* disposed about notch 36 of through-hole 34 through which projection 240 is passed. Locking tabs 225*a*, 225*b* are formed as triangular shaped wedges in the illustrated embodiment and prevent projection 240 from being aligned with notch 36 via unintended rotation of lower pin 222 as projection 240 will bump into either projection 225*a* or 225*b* unless lower pin 222 is first further extended against the force of spring 223 such that projection 240 will clear locking tabs 225*a*, 225*b* during rotation of lower pin 222. As shown in FIG. 7B, a washer or retainer 227 may be secured to shaft 221, such as by welding, to act as a stop for spring 223.

Therefore, the present invention provides securement devices positioned on shipping racks that are configured for stacked arrangement, where the securement devices include chains or tethers that rest in vertical channels of brackets when not in use. The tethers are movable to extend upwardly from the bracket of a lower shipping rack to be at least partially received in the bracket of an upper shipping rack, where the tether is releasably coupled to a lower pin of the bracket of the upper shipping rack 12*a*, and thus provides a clear visual indication that the racks are locked together, in the form of the tether spanning between shipping racks that are spaced atop one another. The lower pin of each bracket may be removable to releasably couple to the tether of a bracket from the shipping rack positioned below. The lower pin may have a radial projection or key to prevent inadvertent or accidental removal of the lower pin. By limiting or preventing vertical movement between adjacent shipping racks, the securement devices may work cooperatively with posts and sockets on the racks to maintain the racks in safe, secure, and non-separable alignment with one another, such as for storing, lifting, and transporting of the shipping racks.

Figure 8:
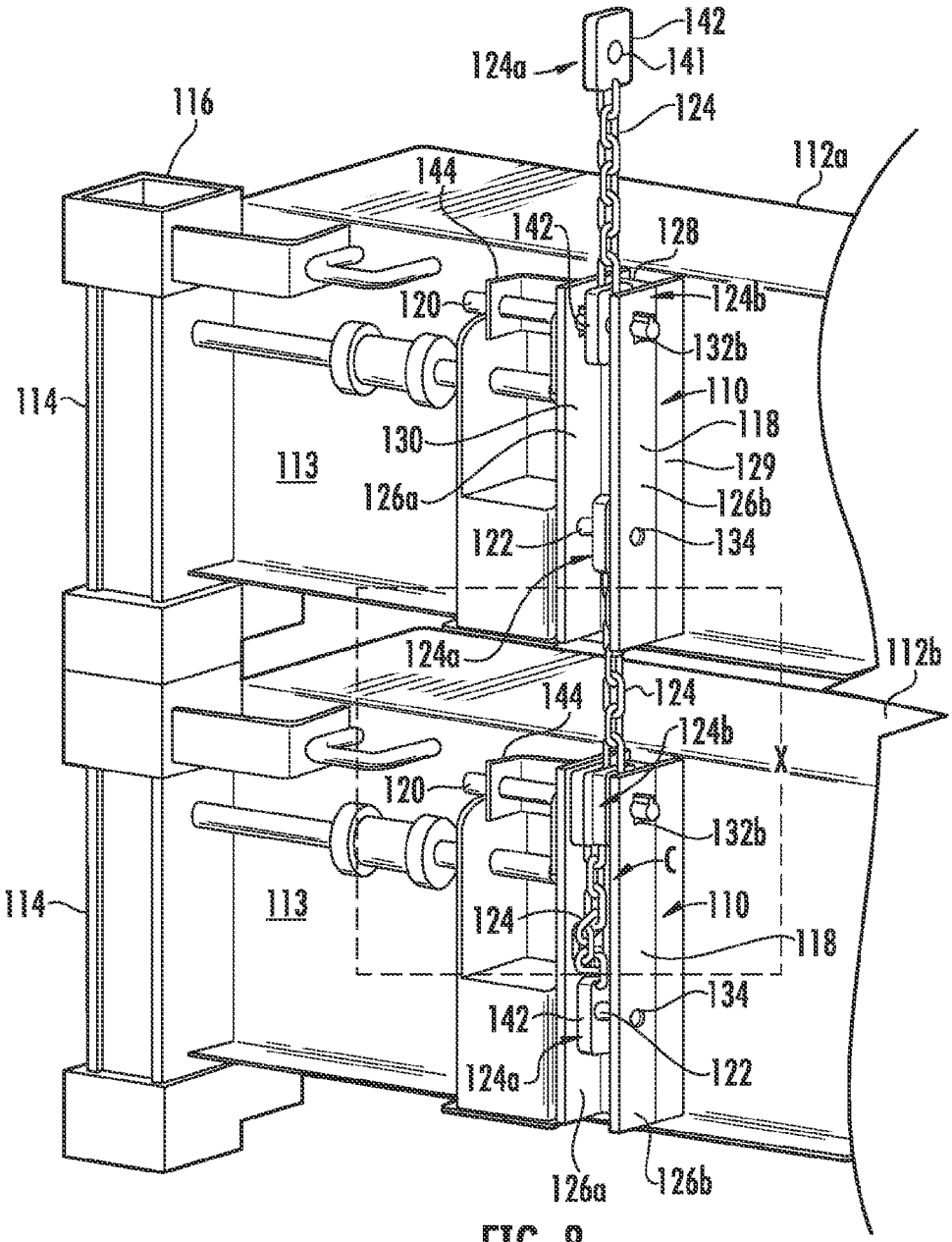
FIG. 8 is a perspective view of portions of a pair of collapsed shipping racks in stacked arrangement, including securement devices in accordance with an alternative embodiment of the present invention.
Figure 9:
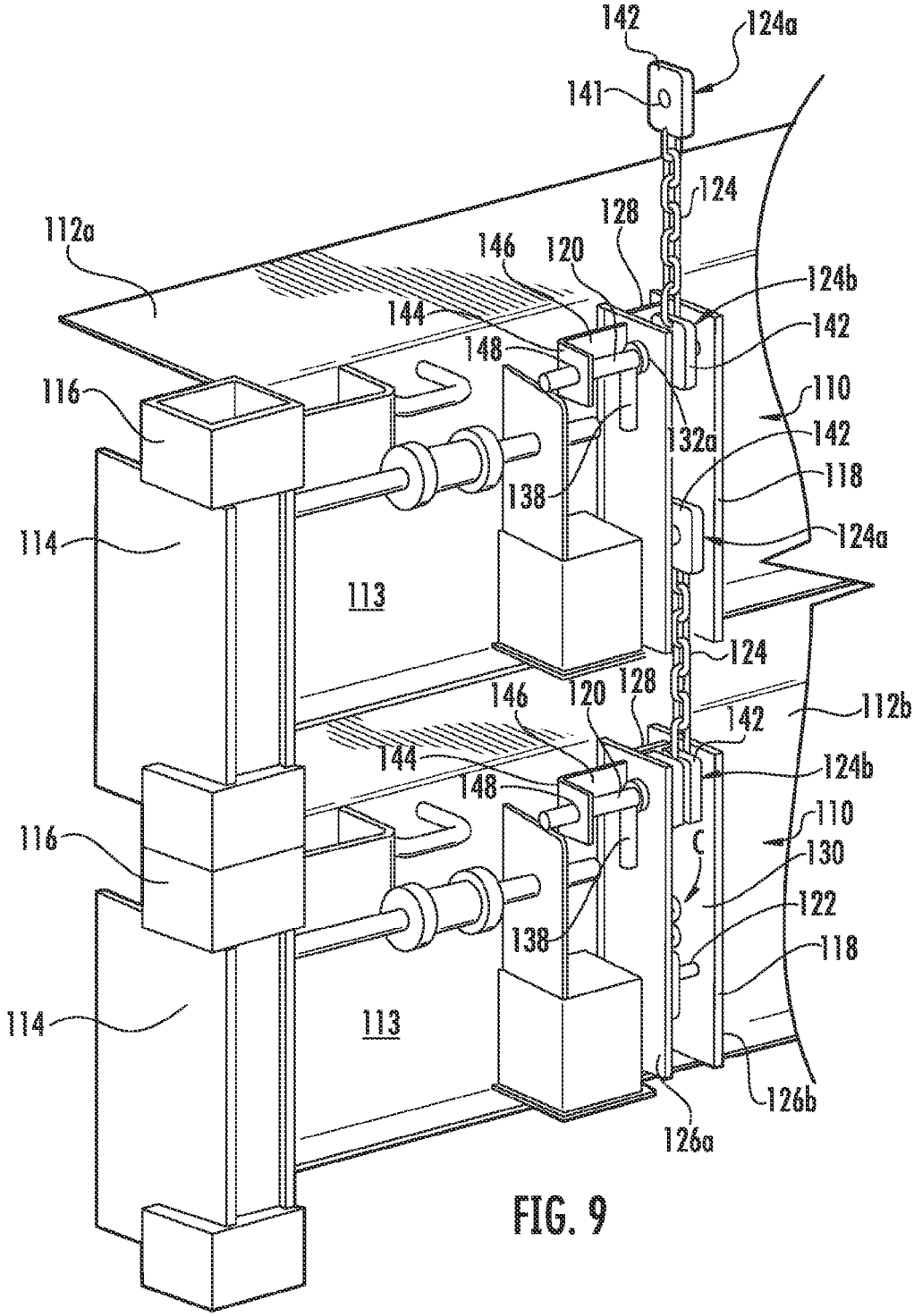
FIG. 9 is another perspective view of the securement devices and shipping rack portions of FIG. 8.
Figure 10:
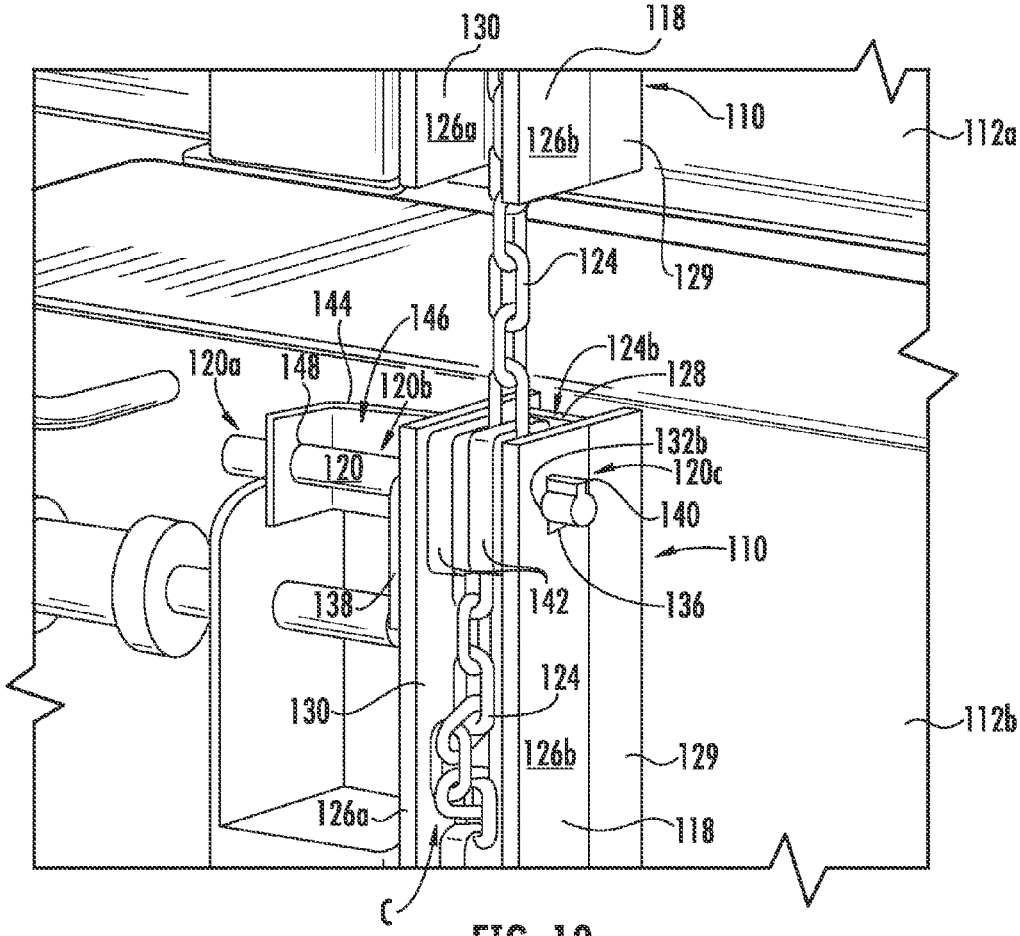
FIG. 10 is an enlarged perspective view of section X of FIG. 8.

Optionally, and with reference to FIGS. 8-10, another securement device 110 is shown in use on shipping racks 112*a*, 112*b* having end sides 113, corner regions 114, and upper corner regions 116. Securement device 110 includes a bracket member 118 supporting an upper pin 120 and a lower pin 122. Like bracket member 18 of securement device 10, bracket member 118 includes a pair of arms 126*a*, 126*b* extending outwardly from a base portion 128 that is welded or fastened to a respective shipping rack 112 (such as via spacer arms 129). A tether 124 (such as a chain or cable or the like) includes a coupling plate 142 at each end for engagement with a respective one of the upper and lower pins 120, 122 through a hole 141 in plate 142. In addition to arms 126, bracket member 118 includes a U-shaped side extension 144 at an upper end for supporting a portion of upper pin 120.

Each arm 126 defines an upper through-hole 132 and a lower through-hole 134. Similar to upper pin 20 and upper through-holes 32 of securement device 10, lower pin 122 may be welded or permanently fastened to arms 126*a*, 126*b* at lower through-holes 134 to permanently couple a first end 124*a* of tether 124 to bracket member 118. Similar to lower pin 22 and lower through-holes 34*a*, 34*b* of securement device 10, upper pin 120 and at least one of upper through-holes 132*a*, 132*b* of securement device 110 may be correspondingly shaped (such as by including a notch 136 in the right upper through-hole 132*b* and a correspondingly shaped radial projection 140 on the upper pin) to permit sliding engagement of the upper pin in the upper through-holes 132*a*, 132*b*, while preventing removal of a distal end portion 120*c* of upper pin 120 from a channel 130 defined by bracket arms 126*a*, 126*b*, such as in a similar manner as described above with respect to lower pin 22 and lower through-holes 34*a*, 34*b* of securement device 10. It should be understood that the coupling plate 142 of first end 124*a* of the upwardly extending upper tether 124 having second end 124*b* affixed to rack 112*a* in FIGS. 8 and 9 would be permanently secured to a third shipping rack (not shown) stacked on top of rack 112*a*.

Upper pin 120 includes a handle extension 138 located outside of channel 130, but inside a channel 146 defined by L-shaped side extension 144, such as best shown in FIGS. 9 and 10. Similar to handle extension 38 and radial projection 40, upper pin 120 includes a handle extension 138, at a middle portion 120*b* thereof, that is substantially aligned with radial projection 140 so as to prevent inadvertent removal of the distal end portion 120*c* of upper pin 120 from channel 130 and first end portion 124*a* of tether 124 (such as at coupling plate 142). U-shaped side extension 144 includes a through-hole 148 for supporting a proximal end portion 120*a* of upper pin, the proximal end portion being located opposite from distal end portion 120*c*. Thus, upper pin 120 is slidable in upper through-holes 132*a*, 132*b* and the through-hole 148 in U-shaped side extension 144 to releasably couple a second end portion 124*b* of a tether 124 to bracket member 118.

To securely couple or join shipping racks that are stacked atop one another, upper pin 120 of the bracket member of the lower shipping rack is first rotated and then at least partially removed from vertical channel 130. Second end portion 124*b* of tether 124 (optionally including coupling plate 142) is then positioned so that a loop or link or through-hole in the tether or coupling plate is aligned with distal end portion 120*c* of upper pin 120, and the upper pin is slid back into place (engaging second end portion 124*b* of tether 124) and rotated to prevent the inadvertent removal of the upper pin. A pin may include two opposed radial projections, or other arrangements of projections, with through holes, such as through holes 132*b* and 141, necessarily requiring corresponding notches through which the radial projections may be passed.

Because tethers 124 are permanently coupled to the lower pins 122 in the illustrated embodiment of FIGS. 8-10, second end portions 124*b* of tethers naturally hang down from lower pins 122 and rest adjacent the upper pins 120 of a bracket member and shipping rack 112*b* located immediately below, even when the tethers 124 are not coupled to the upper pins 120. Coupling plates 142, which are generally rectangular metal plates with through-holes sized to receive upper pins 120, may act to mitigate the risk that tethers 124 will appear to be coupled to upper pins 120 when they actually are not, because coupling plates 142 may be sized so that they will tend to rest substantially outside of vertical channel 130 when they are not coupled to upper pins 120.

Optionally, in order to further mitigate the risk of uncoupled tethers 124 presenting the false appearance of being coupled to upper pins, it may be desirable to couple the distal end portion 124*b* of any disconnected tether 124 to the upper pin 120 of the same bracket, such as shown at 'C' in FIGS. 8 and 10, thus preventing disconnected tethers from hanging or dangling down and creating the appearance of being coupled to the bracket of the shipping rack below. By securing the second end portions 124*b* of the unused tethers 124 to removable upper pins 120 of the same bracket, the tethers 124 are also prevented from contacting or dragging on a support surface, such as when the tethers are coupled to a lowermost shipping rack in a stack of shipping racks. In FIG. 8, for example, three tethers illustrate the above concept in which (i) the middle tether couples the upper shipping rack to the lower shipping rack, (ii) the lower tether (at 'C') is not in use, but its second end portion is coupled to the upper pin 120 of the same bracket (in this case, the coupling plates 142 of each second end portion 124*b* of both the middle and lower tethers are adjacent one another on the upper pin 120 of the lower bracket member 118), and (iii) the upper tether is releasably coupled to the upper shipping rack's bracket member's upper pin and permanently coupled to the lower pin (not shown) of a bracket (not shown) of a third shipping rack (not shown) located directly above the middle shipping rack.

It will be appreciated that in any of the embodiments described herein, either of the upper and lower pins may be fixed to its respective bracket member, with the other pin being releasably attachable to the other pin (i.e. lower or upper pin) of an adjacent shipping rack, without departing from the spirit and scope of the present invention. By selecting the upper pins as fixed and the lower pins as removable, or vice versa, a user may determine the visual cues provided by the tethers that are connected versus those that are disconnected, as well as the procedure used for coupling and decoupling the tethers from the removable pins. In any embodiment, all or portions of the securement devices may be color coded. For example, with reference to the embodiment of FIGS. 2-5, tethers 24 may be yellow and/or bracket members 18 may be red, or some other color. In this manner, a visual inspection of the stacked shipping containers may enhance confirmation of whether tethers 24 extend between the gaps of adjacently stacked shipping containers indicating that the shipping racks as being secured together or whether the tethers 24 are disposed within channels 30 indicating that they have not yet been secured together.

Changes and modifications to the specifically described embodiments may be carried out without departing from the principles of the present invention, which is intended to be limited only by the scope of the appended claims, as interpreted according to the principles of patent law.

We claim:

1. Collapsible shipping rack securement devices securing adjacent shipping racks together when collapsed and stacked:

each said securement device comprising a bracket member, upper and lower pin members coupled at said bracket member, and a tether having first and second opposite end portions with said first end portion of said tether being coupled to one of said upper and lower pin members and said second end portion being releasably attachable to another said securement device;

wherein said second end portion of said tether of a first said securement device at a first collapsible shipping rack is releasably attachable to a second said securement device of a second collapsible shipping rack when the first shipping rack is adjacently stacked relative to the second collapsible shipping rack to securely and releasably couple the first collapsible shipping rack and the second collapsible shipping rack together in a stacked arrangement; and wherein on each said securement device either said upper pin member or said lower pin member is fixedly coupled at said bracket member to define a fixedly coupled pin member and the other of said upper pin member and said lower pin member is releasably coupled at said bracket member to define a releasable pin member with said first end portion of said tether being engaged by said fixedly coupled pin member to generally fixedly attach said first end portion of said tether to said bracket member, and wherein said second end portion of said tether of each said securement device is releasably engagable by said releasable pin member of another said securement device; and wherein on each said securement device said bracket member includes a through-hole for movably receiving said releasable pin member, with said releasable pin member being movable to releasably attach said tether from another said securement device.

2. The shipping rack securement devices of claim 1, wherein said second end portion of said tether from a third said securement device of a third collapsible shipping rack is releasably attachable to the first said securement device of the first collapsible shipping rack with the first collapsible shipping rack being stacked between the second and third collapsible shipping racks.

3. The shipping rack securement devices of claim 1, wherein said tether of each said securement device comprises a chain.

4. The shipping rack securement devices of claim 1, wherein on each said securement device said upper pin member is fixedly coupled at said bracket member to define said fixedly coupled pin member and said lower pin member is releasably coupled at said bracket member to define said releasable pin member, whereby the second collapsible shipping rack is stacked above the first collapsible shipping rack.

5. The shipping rack securement devices of claim 4, wherein on each said securement device said through hole of said bracket member movably receives said lower pin member, whereby said tether of a third said securement device of a third collapsible shipping rack is releasably attachable to the first said securement device on the first collapsible shipping rack with the first collapsible shipping rack being stacked above the third collapsible shipping rack.

6. The shipping rack securement devices of claim 5, wherein said lower pin member of each said securement device comprises a shaft including a projection extending generally radially outwardly from said shaft to selectively prevent said shaft from being displaced through said through-hole.

7. The shipping rack securement devices of claim 6, wherein said lower pin member further includes a spring, and wherein said spring biases said projection against said bracket member to prevent said lower pin from being displaced through said through-hole.

8. The shipping rack securement devices of claim 6, wherein said tether of each said shipping rack comprises a chain.

9. The shipping rack securement devices of claim 6, wherein said bracket member comprises a pair of generally vertical plates defining said channel such that said channel comprises a vertical channel spanned by said upper and lower pin members, and wherein said vertical channel of said first securement device is generally vertically aligned with said vertical channels of said second securement device when the first collapsible shipping rack is adjacently stacked relative to the second collapsible shipping rack.

10. The securement devices of claim 1, wherein each said bracket member includes a channel defining an opening, and wherein said tethers are moveable through said opening for releasably attaching to an adjacent said securement device.

11. The shipping rack securement devices of claim 1, wherein a plurality of said securement devices are mounted to each of the first collapsible shipping rack, the second collapsible shipping rack, and a third collapsible shipping rack, and wherein said securement devices on the first collapsible shipping rack are engagable with said securement devices on the second and third collapsible shipping racks when the first collapsible shipping rack is stacked between the second and third collapsible shipping racks.

12. The shipping rack securement devices of claim 11, wherein said securement devices on the first collapsible shipping rack are vertically aligned with said securement devices on the second and third collapsible shipping racks when the first collapsible shipping rack is stacked between the second and third collapsible shipping racks.

13. The shipping rack securement devices of claim 1, wherein on each said securement device said lower pin member is fixedly coupled at said bracket member and said upper pin member is releasably coupled at said bracket member with said first end portion of said tether being engaged by said lower pin member, and wherein and said second end portion of said tether of said first securement device is releasably engageable by said upper pin member of said second securement device when the second collapsible shipping rack is stacked below the first collapsible shipping rack.

14. Shipping racks that are stackable, said shipping racks comprising:

a plurality of sides, with each said shipping rack including a securement device mounted to a said side, each said securement device including a bracket member, first and second pin members coupled at said bracket member, and a tether having first and second opposite end portions, with said first end portion of said tether being coupled to said first pin member;

wherein said second end portion of each said securement device is releasably attachable to said second pin member of another said securement device of an adjacently stacked said shipping rack to secure adjacent said shipping racks together in a stacked arrangement; and wherein said first pin member on each said securement device is fixedly coupled at said bracket member and said second pin member is releasably coupled at said bracket member with said first end portion of said tether being engaged by said first in member to generally fixedly attach said first end portion of said tether to said bracket member, and wherein said second end portion of said tether of each said securement device is releasably engagable by said second pin member of another said securement device; and wherein on each said securement device said bracket member includes a through-hole for movably receiving said second pin member, with said second pin member being movable to releasably attach said tether from another said securement device.

15. The shipping racks of claim 14, wherein said second pin member of each said securement device is movable relative to its respective bracket member to releasably attach said tether from another said securement device of an adjacently stacked shipping rack.

16. The shipping racks of claim 15, wherein each said second pin member comprises a shaft and includes a projection extending generally radially outwardly from said shaft to selectively prevent said shaft from being displaced through said through-hole.

17. The shipping racks of claim 16, wherein said second pin member further includes a spring, and wherein said spring biases said projection against said bracket member to prevent said second pin member from being displaced through said through-hole.

18. The shipping racks of claim 14, wherein each said shipping rack includes a plurality of said securement devices.

19. The shipping racks of claim 14, wherein said first pin member of each said securement device is coupled to its respective said bracket member vertically above said second pin member relative to the operational orientation of said shipping racks.

20. The shipping racks of claim 14, wherein said bracket member of each said securement device includes a channel defining an opening, and wherein said tethers are moveable through said opening for releasably attaching to said securement device of an adjacently stacked said shipping rack.

21. The shipping racks of claim 20, wherein said bracket members comprise a pair of generally vertical plates defining said channel whereby said channel comprises a vertical channel spanned by said first and second pin members, and wherein said vertical channel of said securement device of one said shipping rack is generally aligned with said vertical channel of said securement device of an adjacently stacked said shipping rack.

22. The shipping racks of claim 14, wherein said tether comprises a chain.

* * * * *

UNITED STATES PATENT AND TRADEMARK OFFICE

CERTIFICATE OF CORRECTION

PATENT NO. : 8,807,863 B2
APPLICATION NO. : 12/854360
DATED : August 19, 2014
INVENTOR(S) : John Pearson, Lewis Vitalis and Michael Chilkotowsky It is certified that error appears in the above-identified patent and that said Letters Patent is hereby corrected as shown below:

Specification

Column 5,
Line 21, “anus” should be --arms--

Claims

Column 10,
Line 52, Claim 9, “channels” should be --channel--

Column 11,
Line 38, Claim 14, “in” should be --pin--

Signed and Sealed this
Twenty-second Day of September, 2015

Michelle K. Lee

Michelle K. Lee
*Director of the United States Patent and Trademark Office*